United States Patent [19]

Wolfe et al.

[11] Patent Number: 4,830,199

[45] Date of Patent: May 16, 1989

[54] HANGING BASKET DISPLAY APPARATUS

[75] Inventors: Ronald D. Wolfe, St. Louis Park; Dale D. Shepard, Bloomington, both of Minn.

[73] Assignee: Liberty Diversified Industries, New Hope, Minn.

[21] Appl. No.: 101,830

[22] Filed: Sep. 28, 1987

[51] Int. Cl.[4] ..... A47F 5/00

[52] U.S. Cl. ..... 211/86; 211/88; 211/113; 211/118

[58] Field of Search ..... 211/113, 118, 117, 86; 248/97, 317, 318, 324; 43/11, 12

[56] References Cited

U.S. PATENT DOCUMENTS

| | | | |
|---|---|---|---|
| 3,913,879 | 10/1975 | Wright | 248/318 |
| 4,015,719 | 4/1977 | Hanople | 248/97 X |
| 4,125,956 | 11/1978 | Killian | 43/11 |
| 4,422,556 | 12/1983 | Moore | 211/117 X |
| 4,561,547 | 12/1985 | Estwanik | 211/113 X |
| 4,631,851 | 12/1986 | Whitehurst | 43/11 X |
| 4,667,913 | 5/1987 | Peelle et al. | 248/317 X |

*Primary Examiner*—Robert W. Gibson, Jr.
*Attorney, Agent, or Firm*—Moore & Hansen

[57] ABSTRACT

A hanging display having a circuitous metal hoop which supports a doubled layer of nylon mesh netting. The netting is initially formed as a tube which is threaded through the hoop and folded back upon itself and knotted to form a basket. The basket is easily deformable to contain a large quantity and variety of products, and returns to its initial shape as products are removed. The hook and netting may be supported from above by cables, on pegboard hooks, or by a freestanding frame member.

29 Claims, 2 Drawing Sheets

HANGING BASKET DISPLAY APPARATUS

BACKGROUND OF THE INVENTION

This invention relates generally to commercial display and advertising racks, and particularly to a hanging display for containing a plurality of product samples in a retail store environment.

Retail stores are generally organized into departments or sections which may comprise an entire region of the store or a small portion of an aisle. Similar products within those departments or sections are generally grouped together and then further subdivided according to a classification system of descending descriptive priorities well recognized by the customers: product nature, function, type, brand, size or color, price, and so forth.

The various established methods for displaying products are generally recognized throughout most retail stores. Products are placed on or within racks, shelves, upright display cases, display counters, tables, bins, pegboard wall displays, and freestanding promotional stands. The particular type of display chosen will depend primarily upon the location of the product within the store, and the type and value of the merchandise. More expensive, fragile, or easily concealable products, and those which normally require greater assistance from sales personnel, may be locked or placed out of reach under a countertop display, on shelving behind a sales counter, or in a display cabinet near the cashier.

Most inexpensive or moderately priced consumer goods are displayed openly on shelves or racks which allow the customers to sort through the various products, compare labels and advertising claims, determine the brand and type of product they desire without assistance, and select the appropriate quantity.

Sale items, specials, discounts, and promotional products, on the other hand, may be placed in bins near the entrances or exits of the store, or at points of heavy customer traffic, where a person can readily observe and easily select one or more of the items on impulse as they pass by, without comparison or reference to other similar products.

Retail merchandisers have also identified many products which should be placed near the cashier or store exit, since customers tend to forget those items ween compiling a shopping list or to consciously consider that purchase, but will remember the particular need when seeing the item while they are waiting to checkout.

The actual display devices most frequently positioned surrounding the cashier's station include the glass top or glass front display counter itself, large wire mesh bins and freestanding receptacles which are placed in front or along the sides of the counter, plexiglas display cabinets or rotating racks which are placed on top of the counter, and shelving located on or against a wall behind the cashier. In some instances, conventional shopping carts and baskets are used in place of the specially designed metal wire stands and receptacles.

These conventional display devices, while being practical for the intended use and providing several utilitarian features, do present some common drawbacks and disadvantages from the perspective of both the retail store owner or employee and the product manufacturer.

Because it is important to utilize the available display space most effectively—particularly the most valuable spaces surrounding the cashier or sales counter—the displays themselves must be designed to occupy a minimum volume while containing the most economically efficient product inventory which should necessarily be kept on hand.

Because this on-hand inventory will vary depending upon the particular product, and the minimum display volume will similarly depend upon the size of each product and the inventory number, most general purpose display stands manufactured for use by retailers lack a sufficient degree of flexibility or are invariable as to sizes, thus preventing their most effective use.

In addition, the prefabricated product bins and wire receptacles are generally very bulky, and must be constructed of a heavy gauge metal to withstand the wear and abuse normally encountered. Because of their heavy weight and large size, only a limited number of such display stands may be placed in any one store location without disrupting the traffic flow or interfering with service. Because the stands are designed to rest on the floor, they do not present the best visibility for products, or permit the products to be viewed completely.

Due to the particular materials and construction methods employed, these displays are relatively expensive, and a limited number are usually purchased and owned by the retail store and used with a multitude of products. The store owners will generally prepare a simple handmade sign which indicates the brand name and price of the product, but will seldom create or utilize more complex advertising materials on their own initiative. Because many diverse styles and designs of such display bins and receptacles are used from store to store, the product manufacturers and distributors have little control, if any, over the content or placement of any advertising signs or promotional materials, and the lack of uniformity of the displays prevents the product manufacturer or distributor from providing the appropriate advertising or informational materials to each store.

Moreover, the receptacles, bins, and displays are themselves not particularly attractive, they can be very hard to assemble, disassemble, store, and ship, and they can present many sharp edges which catch upon clothing or scratch customers.

When an entire display is designed and provided by the product manufacturer or distributor, it is traditionally a more expensive and permanent freestanding or countertop display. Such displays are generally designed for long term use with one particular brand and type of product, and may be constructed from plexiglas or injection molded. Another display device supplied by manufacturers or distributors comprises a large freestanding sign or placard designed to attract a customer's attention, many of which have a pocket or tear-off pad for informational pamphlets, and which are related to a particular short term promotional program. While relatively less expensive to manufacture than permanent displays, these placards can generally only be used once, and with a predetermined quantity of a single product.

BRIEF SUMMARY OF THE INVENTION

It is therefore an object of this invention to design a sales promotion display device for containing a plurality of products in a retail store environment.

It is another object of this invention to design the above display device to be very inexpensive to manufacture and distribute in large quantities, and yet extremely durable, reuseable several times with various diverse and unrelated products, and capable of serving a promotional function at both the wholesale distribution or retail sales level.

It is an additional object of this invention to design the above display device such that it is capable of being easily and repeatedly assembled and later disassembled without requiring tools, that it be lightweight, and that each complete device may be individually selled within a very compact package for storage or shipping.

It is a distinct object of this invention to design the above display device such that it is flexible or adaptable to hold and display a variety of products and quantities thereof, without consuming excess space beyond that required for the quantity of products.

It is a related object of this invention to design the above display device such that a large product capacity both in terms of volume and weight may be contained within the display device, with the display device being readily deformable to accommodate various sizes or different shapes of products.

It is yet another object of this invention to design the above display device such that it may display products generally at the eye level of the customer, yet without impinging upon available countertop or floor space nor detracting for the ability of sales personnel to provide customer service.

It is a related object of this invention to design the above display device such that it provides maximum visibility from all sides for the products contained therein, and permits customers an opportunity to easily select and inspect the products prior to purchase.

It is still another object of this invention to design the above display device such that it may contain integral product information, either in the form of uniform custom advertising provided by the manufacturer or distributor, including product logos and promotional or informative materials, or created and produced by the retail sellers themselves.

It is a related object of this invention to design the above display device such that product manufacturer or distributors may supply the display device to the retail sellers on a promotional basis, or the retail sellers may obtain the display device at cost from an independent source, and the product manufacturers or distributors may supply updated advertising materials with their products for use with the display device.

It is a further object of this invention to design the above display device such that it may be manufactured in a variety of shapes and designs using a minimum of interchangeable components, and then utilized in several different manners depending upon the constraints of the particular retail environment.

It is thus a related object of this invention to design the above display device such that the retail sales person may adapt or modify the display device to a particular selected configuration which conforms to a predetermined promotional plan, or to compliment the surrounding decor of the retail store.

Described briefly, the hanging display of this invention includes a continuous metal hoop which supports a doubled layer of nylon mesh netting. The netting is initially formed as a tube which is threaded through the hoop and folded back upon itself and knotted to form a basket. The basket is easily deformable to contain a large quantity and variety of products, and returns to its initial shape as products are removed.

The hoop and netting may be supported from above by cables, on pegboard hooks, or by a freestanding frame member. The hoop may be circular, square, rectangular, octagonal, or any other suitable shape, and an optional reinforcing tray may be inserted into the netting to further modify the appearance of the display device.

Printed advertising, promotional or informational materials may be appended to the display device in a variety of ways, thereby cooperating with and enhancing the overall shape and visual appearance of the display device to produce a particular theme. The entire display device, including the accompanying printed matter, may be enclosed within a single sealed package having the same exterior dimensions as the hoop member.

DESCRIPTION OF THE PREFERRED EMBODIMENTS

The product display device of this invention is shown in FIGS. 1–8 and referenced generally therein by the numeral 10.

Figure 1:
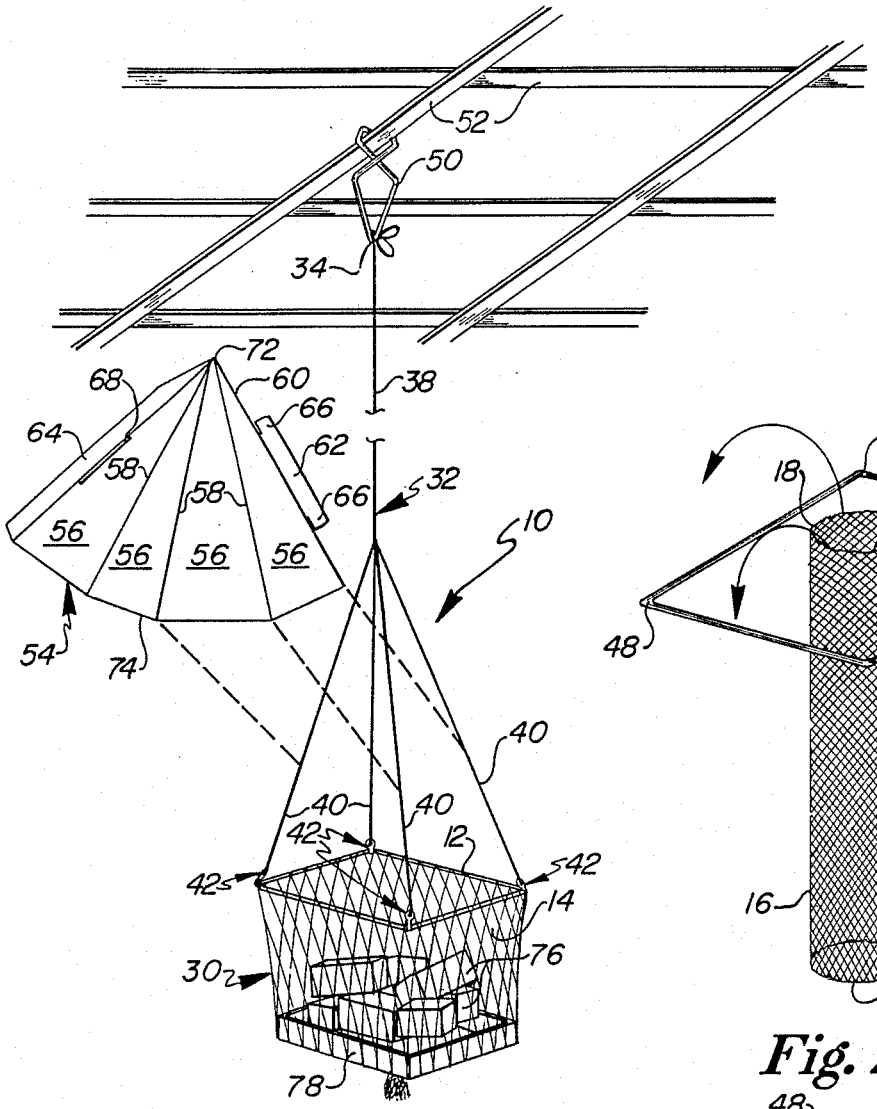
FIG. 1 is a partially exploded perspective view of the hanging basket display device of this invention.

Referring to FIG. 1, a first embodiment of the product display device may be seen. This particular embodiment comprises a rectangular hoop member 12 constructed from a one eighth inch diameter stainless or chromed rigid metal wire, and a netting member 14 formed from a cylindrical tube of nylon mesh 16. The hoop member 12 may be constructed by bending a straight length of rigid wire into a substantially continuous and circuitous path forming a loop, and welding or soldering the opposing ends of the wire together. The nylon mesh 16 may be of any durable, wear resistant plastic resin or polymer, the nylon mesh 16 commonly used to construct packaging for produce such as potatoes, onions, fruits, etc., being suitable. The hoop member 12 may be constructed of any generally rod-like rigid material which may be deformed to a predetermined and selected loop shape, and will maintain that loop shape. The mesh 16 may be of any type having interwoven or connected strands or fibers and providing spaces between the strands or fibers sufficient to permit viewing therethrough.

Figure 2:
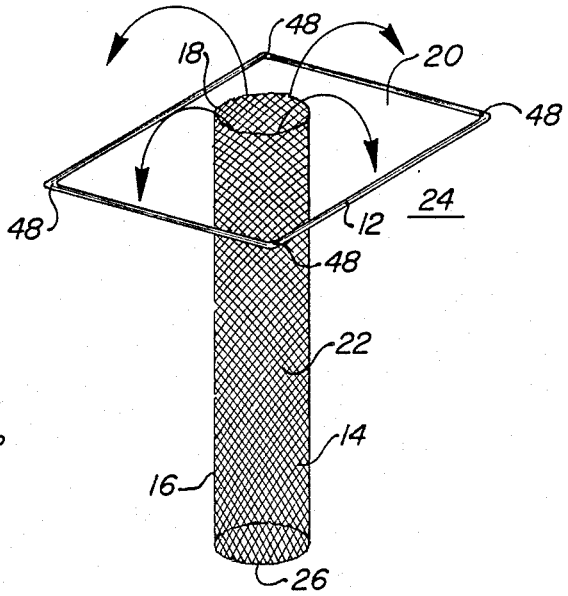
FIG. 2 ia an exploded perspective view showing the first end of the mesh tube being inserted through the interior region of the hoop member of the hanging basket display device of FIG. 1.
Figure 3:
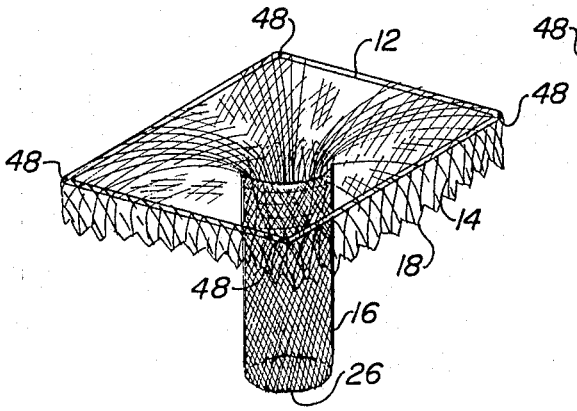
FIG. 3 an exploded perspective view showing the first end of the mesh tube being folded over the hoop member and back upon itself.
Figure 4:
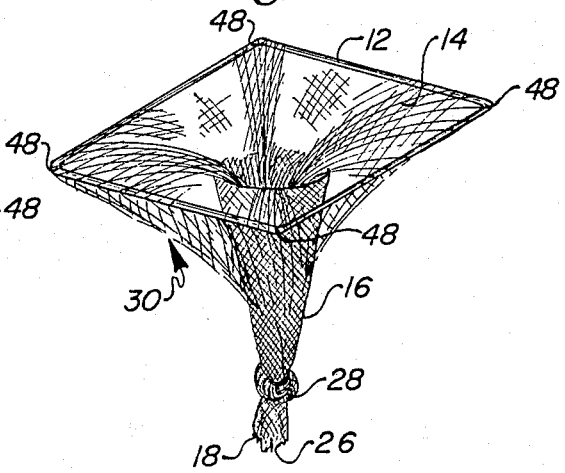
FIG. 4 is a perspective view of the completed basket assembly of the hanging basket display device of FIG. 1.

Referring to FIGS. 2–4, it may be seen that the nylon mesh 16 is mounted on the hoop member 12 by passing one end 18 of the tube of nylon mesh 16 through the interior 20 of the hoop member 12 to approximately the midpoint 22 of the tube 16, and then folding that end 18 of the tube 16 backwards upon itself along the exterior side 24 of the hoop member 12 and the exterior side of the mesh tube 16, and aligning the end 18 of the tube 16 with the opposing end 26 of the tube 16 such that the opposing end 26 is even with and encircled by the first end 18. The ends 18, 26 of the tube 16 may then be tied in a knot 28 to secure the mesh 16 on the hoop member 12 and form a closed-bottom receptacle region or basket assembly 30. The hoop member 12 cannot then be removed from the mesh 16 without untying the knot 28.

Figure 8:
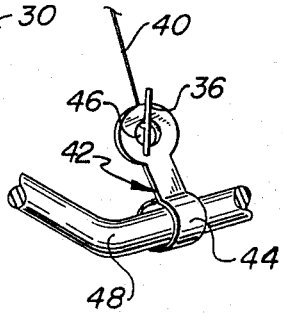
FIG. 8 is a detail perspective view of showing the cable, metal clip, and eyelet assembly of the hanging basket display device of FIG. 1.

The basket assembly 30 may then be supported from above by four cables 40. The four cables 40 are aligned in an overlapping bundle 32, and attached together between one end 34 and the underpoint to form a straight bundled segment 38 and four divergent segments 40. As is shown in FIG. 8, each divergent segment 40 of the cable 32 has a similar hook member, preferably in the form of a T-clip 36 attached at the free end thereof. Four eyelet fasteners 42 each having a tab section 44 and an eyelet section 46 are attached to the hoop member 12 near the corners 48 by bending the tab section 44 around the hoop member 12. The T-clips 36 attached to the cables 32 may be passed through the eyelet sections 46 and will be securely but removably engaged therein as shown in FIG. 8.

The free end 34 of the straight bundled segment 38 of the cable bundle 32 may be tied to a hanging clip 50 which may be fastened or mounted on a ceiling panel beam member 52 or other similar projection or overhead fixture, such that the basket assembly 30 will be suspended at approximately eye level to a customer with the hoop member 12 generally horizontal.

The basket assembly 30 may be inverted such that the knot 28 is on either the interior or exterior of the basket assembly 30 depending upon the particular visual effect desired, or the portion of the tube 16 hanging below the knot 28 may be removed. By altering the relative lengths of the cable segments 40, it is also possible to have the hoop member 12 suspended at and angle in one or more directions, and the mesh 16 may be adjusted around the hoop member 12 so that the basket assembly 30 will hang properly.

A placard 54 having printed matter on one or both sides is constructed from a sheet of glossed cardboard, fiberboard, or plastic cut to the form shown in FIG. 1. The placard 54 consists of four triangular panels 56 which are hingedly connected along scored fold lines 58 dividing the side edges of the panels 56. Extending from and hingedly connected to one free end 60 of a panel 56 is a locking tab 62, and extending from and hingedly connected to the opposing edge of the placard 54 is an en flap 64. The locking tab 62 presents two side projections 66, and the end flap 64 and adjoining panel 56 define a slot 68 having a length approximately equal to the distance between the two projections 66 on the locking tab 62. The panels 56 may thus be folded together across the scored fold lines 58, with the locking tab 62 being inserted in the slot 68 to secure the panels 56 in a pyramidal configuration proportional to that of the divergent segments 40 of the cable bundle 32.

The panels 56 may be folded around the cable segments 40, or the free end 34 of the cable bundle 32 may initially be threaded through the apex 72 of the folded placard 54 prior to the cable bundle 32 being attached to the hanging clip 50, with the placard 54 thereby being supported by the T-clips 36 and the diverging cable segments 40.

The exterior side of the placard 54 is pre-printed while in the flattened placard form 54 with advertising or promotional information, and each side of the placard 54 may be printed with different information allowing the retailer to choose the appropriate side for the display 10.

One example of a set of suitable dimensions for the above embodiment of the product display device 10 would include a rectangular hoop member 12 constructed of $\frac{1}{8}''$ diameter stainless wire having sides approximately $8'' \times 10''$ in length, a cylindrical tube of nylon mesh 16 approximately 36″ in length and having an unstressed diameter of 6″–8″ or a stressed circumference of approximately 36″, cable bundle 32 approximately 36″ in length with the straight bundled segment 38 being 16″ long and the divergent sections 40 being 20″, and a placard 54 having triangular panels 56 with scored fold lines 58 which are 10″ in length and bottom edges 74 which are alternately $4\frac{3}{4}''$ smf $3\frac{3}{4}''$ in length.

The display device 10 as described above is capable of containing and supporting any number of items 76.

Referring to FIG. 1, it may be seen that the overall shape or configuration of the fully constructed product display device 10 may be altered or modifies by inserting a reinforcing tray 78 into the bottom of the basket assembly 30. This reinforcing tray may be of any suitable size, shape, or material, although a clear plastic injection molded polystyrene has proven suitable. This tray 78 will serve to reinforce the nylon mesh 16 along the bottom of the basket assembly 30, and to hold the basket assembly open and in a particular configuration when only a small quantity of products 76 remain in the basket assembly 30.

Figure 5:
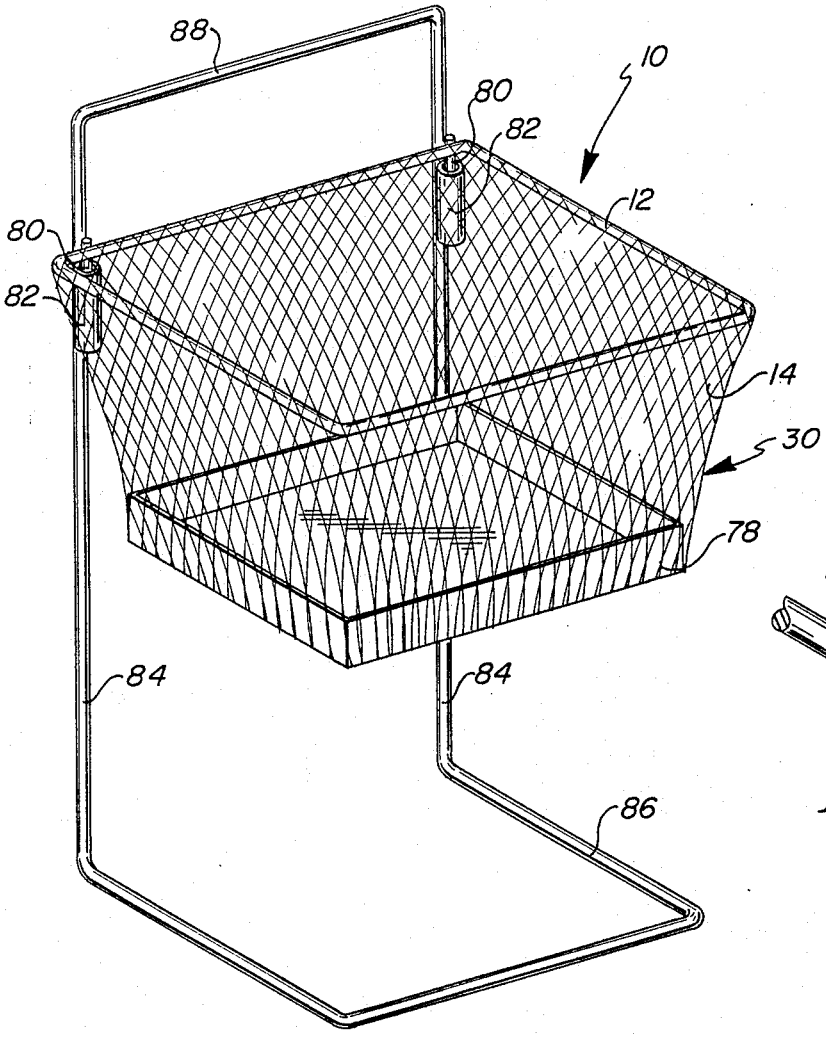
FIG. 5 is a perspective view of an alternate freestanding embodiment of the hanging basket display device of this invention.

Referring to FIG. 5, an alternate freestanding embodiment of the display device 10 is shown. In this embodiment, the hoop member 12 includes a pair of opposing depending wire projections 80 which are welded or otherwise attached to one side of the hoop member 12. The depending wire projections 80 are received in correspondingly aligned vertical tubular supports 82 similarly attached to a pair of spaced apart vertical legs 84 connected at the bottom thereof by a U-shaped horizontal base member 86 and at the top thereof by a top cross member 88. In this embodiment, the display device 10 may stand on a counter or table, and a folded advertising placard may be attached to the top cross member 88.

Figure 6:
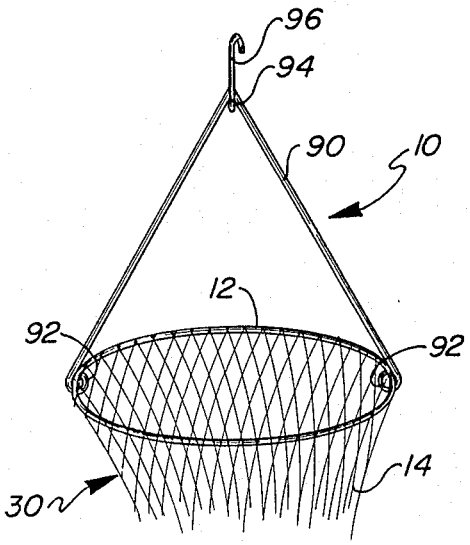
FIG. 6 is a perspective view of an alternate embodiment of the hanging display device of this invention.

Referring to FIG. 6, an alternate embodiment of the display device 10 wherein the hoop member 12 is circular and the cables 32 have been replaced by an angled support wire 90 is shown. The support wire 90 has a pair of opposing ends 92 which may be bent together at an acute angle and each end 92 looped to encircle the hoop member 12, thus fastening the support wire 90 to the hoop member 12 and presenting an apex 94 whereat a hanging hook 96 may be welded or otherwise attached.

Figure 7:
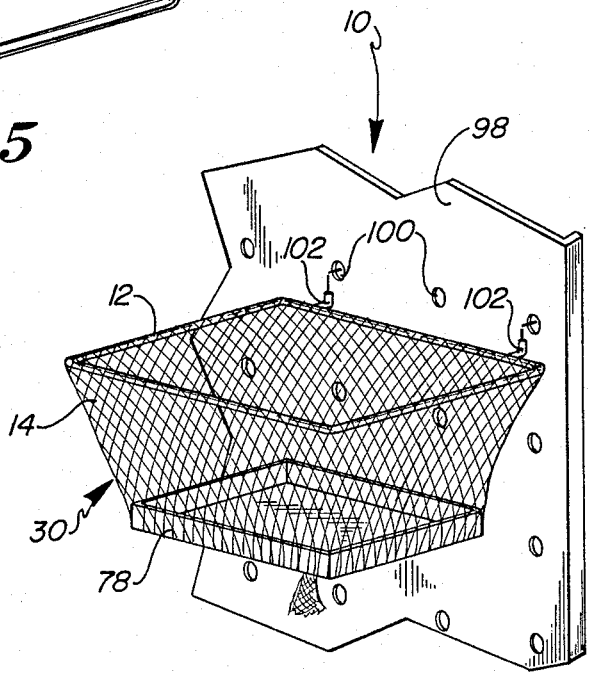
FIG. 7 is a perspective view of an alternate pegboard hung embodiment of the hanging basket display device of this invention.

Referring to FIG. 7, there is shown an additional alternate embodiment of the display device 10 designed to be used with a conventional pegboard 98 having a plurality of spaced apart orifices 100, the hoop member 12 having attached thereto a pair of opposing pegboard hangers 102 of the type well known and utilized in combination with pegboard 98.

It is understood that several of the features of the various embodiments described may be used in differing combinations to achieve varied aesthetic and functional advantages, and may incorporate a wide variety of ornamentation designed to augment the advertising and promotional uses of the display device 10.

While the preferred embodiments of the present invention have been described above in reference to the accompanying drawings, it is understood that the invention may be further modified or altered without departing from the spirit and scope of the appended claims.

What is claimed is:

1. A display device for displaying several product articles, comprising:

a hoop member, said hoop member being formed into substantially circuitous loop shaped defining an interior region and an outside and being oriented in a generally horizontal plane;

a netting member, said netting member being formed from a mesh-like material having a plurality of interconnected strands and providing spaces between said strands such that the articles may generally be visible therethrough and further defining a closed-bottom receptacle region, said netting member being mounted on and supported by said hoop member such that said netting member depends from said generally horizontally oriented hoop member, said netting member being a generally cylindrical tube of mesh material having a pair of opposing ends and defining an interior region and an exterior region, one said end of said tube passing through said interior region of said hoop member and said opposing end being folded back over said outside of said hoop member upon said exterior region of said one end of said tube, said opposing ends of said tube being fastened together to mount said netting member on said hoop member and form said closed-bottom receptacle region; and support means secured to said hoop member for supporting said hoop member and said net member, whereby the articles may be passed through the interior region of the hoop member and received within the netting member and supported by the hoop member and the netting member so as to be visible through the netting member.

2. The display device of claim 1 wherein the ends of the tube of mesh material are fastened together by a knot.

3. The display device of claim 1 wherein the display device is suspended from an overhead fixture, and wherein the support means for supporting the hoop member comprises:

a plurality of cable members, each said cable member being connected at one or more points to the hoop member; and means for attaching said plurality of cable members to the overhead fixture such that the hoop member is suspended therefrom.

4. The display device of claim 3 wherein each cable member has at least one end connected to the hoop member, and wherein the display device further comprises:

a plurality of hook members, each of said hook members being attached to one end of the cable members connected to the hoop member; and a plurality of eyelet fastener members, each eyelet fastener member defining an aperture extending through the surface of said eyelet fastener member, each said eyelet fastener member engagingly receiving one of said hook members, said eyelet fastener members being attached to the hoop member.

5. The display device of claim 3 wherein the hoop member is generally rectangular in shape and has four corners, and wherein the number of cable members is four, each said cable member being attached to one of said corners of the hoop member.

6. The display device of claim 1 wherein the display device is suspended from a fixture, and wherein the support means for supporting the hoop member comprises:

at least one support rod member, said support rod member having at least one end connected to the hoop member.

7. The display device of claim 6 wherein the ends of the support rods connected to the hoop member are bent so as to substantially encircle the hoop member and closely confront the support rod.

8. The display device of claim 6 wherein the support rods each have a pair of opposing ends, said support rods being bent at an angle, with each of said opposing ends o the support rod being connected to the hoop member.

9. The display device of claim 8 wherein the hoop member has a generally circular shape with a diameter, and wherein the number of support rods is on,, each end of the support rod being connected to the hoop member at a point, whereby each of said points generally diametrically opposes one another relative to the diameter of the hoop member.

10. The display device of claim 7, wherein the hoop member has a generally rectangular shape defining four vertices, and wherein the number of support rods is two, each end of each of the support rods being connected to the hoop member adjacent one of said vertices.

11. The display device of claim 7 wherein the hoop member has a generally hexagonal shape defining six vertices, and wherein the number of support rods is two, each end of each of the support rods being connected to the hoop member adjacent one of said vertices.

12. The display device of claim 7 wherein the hoop member has a geometric shape defining a number of sides and a number of vertices equal to said number of sides, and wherein the number of support rods is at least two, each end of each of the support rods being connected to the hoop member adjacent one of said vertices.

13. The display device of claim 12 wherein the number of sides is even and the number of support rods is one half the number of sides.

14. The display device of claim 1 wherein the display device is suspended on a pegboard having a generally planar surface, said pegboard defining a plurality of apertures extending through said generally planar surface, said support means further comprising:

one or more pegboard hangers, each said pegboard hanger being attached to the hoop member, and each said pegboard hanger further defining a free end, said free end being received within one of the apertures in the pegboard whereby the display device is supported by the pegboard.

15. The display device of claim 14 wherein the hoop member has a generally curved segment and a generally straight segment, and wherein the number of pegboard hangers is two, each of the pegboard hangers being attached to the hoop member adjacent to said generally straight segment of the hoop member.

16. The display device of claim 15 wherein the generally straight segment of the hoop member has a pair of opposing ends, and further wherein one of the pegboard hangers is attached to the generally straight segment adjacent each of said opposing ends.

17. The display device of claim 15 wherein the generally curved segment of the hoop member is oriented at a predominantly acute angle relative to the generally planar surface of the pegboard.

18. The display means of claim 1 wherein the display device is rested on a supporting surface, and wherein the support means for supporting the hoop member further comprises:

a stand member, said stand member having a base portion and a generally upright portion extending substantially upwardly from said base portion; and means for mounting the hoop member on said generally upright portion of said stand member, whereby the base portion of the stand member may be rested upon the supporting surface with the hoop member attached to the upright portion of the stand member.

19. The display device of claim 18 wherein the means for mounting the hoop ember on the generally upright portion of the stand member comprises:

one or more tubular members attached to the generally upright portion of the stand member, each tubular member defining an aperture extending at least partially therethrough; and one or more finger-like projections, each finger-like projection being attached to and extending from the hoop member, each finger-like projection having a free end engagingly received within said aperture of a corresponding aligned one of said tubular members.

20. The display device of claim 18 wherein the means for mounting the hoop member on the generally upright portion of the stand member comprises:

one or more tubular members attached to the hoop member, each tubular member defining an aperture extending at least partially therethrough; and one or more finger-like projections, each finger-like projection being attached to and extending from the generally upright portion of the stand member, each finger-like projection having a free end being engagingly received within said aperture of a corresponding aligned one of said tubular members.

21. The display device of claim which is viewed by a person, said display device further comprising:

a display placard, said display placard being mountable on said display device, said display placard further bearing printed matter visible to the person viewing the display device.

22. The display device of claim 21 wherein the display placard is constructed from a generally planar blank of sheet material, said blank having a plurality of scored fold lines defining a plurality of generally triangular panels hingedly connected along said fold lines, said panels being folded across said fold lines and secured to form a generally upright geometric structure.

23. The display device of claim 22 wherein the number of triangular panels is for and the shape of the generally upright geometric structure is a rectangular pyramid.

24. The display device of claim 23 wherein the hoop member has a generally rectangular shape having four corners, and wherein the support means for supporting the hoop member comprises a plurality of cable members, each cable member having at least one end connected to one of said corners, said cable members further being interconnected at an apex from which they diverge toward said corners, and further wherein the display placard is folded around said four diverging cable members.

25. The display device of claim 1 further comprising: a shape-forming tray member, said tray member being inserted through the hoop member and received within the netting member such that said shape-forming tray member deforms the netting member to conform to a predetermined shape.

26. A display device for displaying several articles of a product, said display device comprising:

a hoop member, said hoop member being oriented in a generally horizontal plane and defining an interior region and an outside;

a netting member, said netting member defining a generally closed-bottom receptable region, said netting member being mounted on and supported by said hoop member such that said netting member depends from said hoop member, said netting member being a generally cylindrical tube of mesh material having a pair of opposing ends and defining an interior region and an exterior region, one said end of said tube passing through said interior region of said hoop member and said opposing end being folded back over said outside of said hoop member upon said exterior region of said one end of said tube, said opposing ends of said tube being fastened together to mount said netting member on said hoop member and from said closed-bottom receptacle region; and support means for supporting said hoop member and said net member, whereby the articles may be passed through the hoop member and received within the netting member and supported by the hoop member.

27. A display device of claim 28 wherein the display device is constructed to be suspended from an overhead fixture, and wherein the support means for supporting the hoop member comprises:

a plurality of cable segments connected at spaced apart points around the periphery of said hoop member, said cable segments being interconnected at an apex point of a cable bundle from which said cable segments diverge outwardly to said spaced apart points of connection on said hoop member, and said called bundle having a straight segment for attachment to an overhead fixture.

28. A method of constructing a display device, said method comprising the steps of:

forming a substantially circuitous hoop member defining an interior region and an exterior region;

passing an end of a cylindrical tube of mesh material having two opposing ends and defining an interior region and an exterior region through the interior region of said hoop member;

folding said end of said tube of mesh material backwards over the exterior region of said hoop member and along the exterior region of said tube of mesh material;

fastening the opposing ends of the tube of mesh material together to form a knot therebetween and define a basket-like receptacle region; and supporting said hoop member in a generally horizontal plane such that said basket-like receptacle region depends from said hoop member.

29. A method of constructing a display device, said method comprising the steps of:

forming substantially circuitous hoop member defining an interior region and an exterior region;

passing an end of a cylindrical tube of mesh material having two opposing ends and defining an interior region and an exterior region over the exterior region of said hoop member such that said hoop member is received within said interior region of said tube of mesh material;

folding said end of said tube of mesh material backwards through the interior region of said hoop member and along the interior region of said tube of mesh material;

fastening the opposing ends of the tube of mesh material together to form a knot therebetween and define a basket-like receptacle region; and supporting said hoop member in a generally horizontal plane such that said basket-like receptacle region depends from said hoop member.

* * * * *